US012539441B2

(12) United States Patent
Martinez

(10) Patent No.: US 12,539,441 B2
(45) Date of Patent: Feb. 3, 2026

(54) BILATERAL RETRACTABLE BAND/CORD DEVICE WITH HANDLES

(71) Applicant: John R. Martinez, New York, NY (US)

(72) Inventor: John R. Martinez, New York, NY (US)

( * ) Notice: Subject to any disclaimer, the term of this patent is extended or adjusted under 35 U.S.C. 154(b) by 93 days.

(21) Appl. No.: 18/655,263

(22) Filed: May 5, 2024

(65) Prior Publication Data

US 2025/0339728 A1 Nov. 6, 2025

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/055*** | (2006.01) |
| ***A63B 23/035*** | (2006.01) |
| ***A63B 23/12*** | (2006.01) |

(52) U.S. Cl.

CPC ..... *A63B 21/153* (2013.01); *A63B 21/00185* (2013.01); *A63B 21/025* (2013.01); *A63B 21/0421* (2013.01); *A63B 21/0552* (2013.01); *A63B 21/4035* (2015.10); *A63B 23/03533* (2013.01); *A63B 23/12* (2013.01)

(58) Field of Classification Search

CPC ..... A63B 21/00185; A63B 21/025; A63B 21/0552; A63B 21/153; A63B 21/157; A63B 23/03533

See application file for complete search history.

(56) References Cited

U.S. PATENT DOCUMENTS

| | | | |
|---|---|---|---|
| 225,376 | A | 3/1880 | Hitchcock et al. |
| 340,915 | A | 4/1886 | Hurd |
| 766,743 | A | 8/1904 | Terry |
| 3,853,283 | A | 12/1974 | Croce |
| 4,018,189 | A | 4/1977 | Umphries |
| 4,114,875 | A | 9/1978 | Deluty |
| 4,540,173 | A | 9/1985 | Hopkins, Jr. |
| 4,733,862 | A | 3/1988 | Miller |
| 4,852,874 | A | 8/1989 | Steichter |

(Continued)

FOREIGN PATENT DOCUMENTS

| | | | |
|---|---|---|---|
| CA | 2634464 | C | 11/2013 |
| DE | 2003200971 | U1 | 6/2003 |

(Continued)

*Primary Examiner* — Zachary T Moore

(57) ABSTRACT

A bilateral retractable band/cord device with handles on both ends. Each handle element attaches to a housing member internally consisting of a spring biased retractable spool axel that protracts outwardly or retracts inwardly a shared band/cord element. A locking mechanism on the outside of each housing member locks the shared band/cord element at any length between the handle elements. When the band/cord element is elastic, this embodiment is a self-contained, bilateral, hand-held, multidimensional exercise tool that is adjustable to variable lengths while maintaining the handle elements for comfort, stability, and portability. The ability to change the materials, sizes, shapes, and designs of each element of this device makes it versatile for a plethora of uses, e.g. an exercise device, a carry-assist device and a belt, with the advantages of stability, comfort, compactness, ease of use, and portability.

20 Claims, 6 Drawing Sheets

(56) References Cited

U.S. PATENT DOCUMENTS

| | | | | |
|---|---|---|---|---|
| 4,909,505 | A | 3/1990 | Tee | |
| 5,147,264 | A | 9/1992 | Braathen | |
| 5,509,873 | A | 4/1996 | Corn | |
| 5,701,981 | A | 12/1997 | Marshall | |
| 5,733,231 | A | 3/1998 | Corn | |
| 6,309,328 | B1 | 10/2001 | Dudley | |
| 6,315,701 | B1 | 11/2001 | Shifferaw | |
| 6,405,683 | B1 | 6/2002 | Walter | |
| 6,537,183 | B1 * | 3/2003 | McCrea | A63B 21/153 482/106 |
| 6,659,922 | B1 | 12/2003 | Yu | |
| 6,770,014 | B2 | 8/2004 | Amore | |
| 7,137,936 | B1 | 11/2006 | Shaw | |
| 7,575,224 | B1 | 8/2009 | Madland | |
| 7,621,856 | B1 | 11/2009 | Keith | |
| 7,931,572 | B1 | 4/2011 | Glauser | |
| 7,942,793 | B2 | 5/2011 | Mills | |
| 8,105,214 | B2 | 1/2012 | J ans | |
| 8,403,818 | B1 | 3/2013 | Wilkinson | |
| 8,562,494 | B2 | 10/2013 | Thomas | |
| 8,651,411 | B2 | 2/2014 | Wang | |
| 8,684,894 | B2 | 4/2014 | Flynn | |
| 8,986,173 | B1 * | 3/2015 | Adams | A63B 21/0726 482/106 |
| 9,022,908 | B2 | 5/2015 | Crowell | |
| 9,265,983 | B1 | 2/2016 | Bell | |
| 9,333,385 | B2 | 5/2016 | Hinds | |
| 9,731,157 | B2 | 8/2017 | Loach | |
| 10,682,540 | B2 | 6/2020 | Mantione | |
| 10,695,604 | B2 | 6/2020 | Porterfield | |
| 10,794,022 | B2 | 10/2020 | Reiner | |
| 11,000,447 | B2 * | 5/2021 | Kokakis | A63B 21/4043 |
| 11,140,874 | B2 | 10/2021 | Bogdahn | |
| 11,282,415 | B2 * | 3/2022 | Kay | E01F 13/028 |
| 11,344,763 | B1 * | 5/2022 | Karnes, Jr. | A63B 21/0557 |
| 11,400,332 | B1 * | 8/2022 | Alford | A63B 24/0062 |
| 11,452,900 | B2 | 9/2022 | Kaye | |
| 11,466,970 | B2 | 10/2022 | Nelson | |
| 2004/0043873 | A1 | 3/2004 | Wilkinson | |
| 2006/0084556 | A1 | 4/2006 | Payne | |
| 2006/0201450 | A1 | 9/2006 | Jordan | |
| 2006/0217247 | A1 | 9/2006 | Potak | |
| 2015/0005141 | A1 | 1/2015 | Krahling | |
| 2017/0028245 | A1 | 2/2017 | Williams | |

FOREIGN PATENT DOCUMENTS

| | | | |
|---|---|---|---|
| DE | 602005003729 | T2 | 1/2008 |
| GB | 2547096 | A | 8/2017 |
| KR | 200468939 | Y1 | 9/2013 |
| WO | WO-2020071986 | A1 | 4/2020 |
| WO | WO-2022098639 | A1 | 5/2022 |
| WO | WO-2003095034 | A2 | 11/2023 |

* cited by examiner

BILATERAL RETRACTABLE BAND/CORD DEVICE WITH HANDLES

CROSS-REFERENCED TO RELATED APPLICATIONS

This application claims the benefit of provisional patent application Ser. No. 63/504,731; filed May 27, 2023 by the present inventor, which is incorporated by reference in its entirety.

FEDERALLY SPONSORED RESEARCH

Not applicable

SEQUENCE LISTING

Not applicable

TECHNICAL FIELD

The present application relates generally to retractable strap devices and more specifically to portable, adjustable band/cord devices with handles.

BACKGROUND

Discussion of Prior Art

A variety of retractable devices for straps, cords, tapes, etc., have been designed for a plethora of uses. Some of these designs include retractable spools for pet leashes, stanchion tops, tape measures, electrical cords, clothing irons, and exercise devices to name a few. Handles and locking mechanisms for comfort and to control length respectively are featured on many of these inventions. A compilation of these retractable devices can be reviewed by reference to the following U.S. Pat. Nos. 10,794,022B2; 6,405,683B1; 4,018,189A; 5,701,981A; 11,282,415B2; 9,265,983B1; 11,466,970B2; 6,315,701B1; 20040043873A1.

Some retractable band/cord devices have a single housing on one end with or without a handle and with or without a locking mechanism, e.g. US20060201450A1; U.S. Pat. No. 11,140,874B2; U.S. Pat. Nos. 3,853,283A; 7,621,856B1. These are often designed for very specific functions that do not require bilateral housing and thus are limited in their scope. Other non-retractable devices have two handles; one on each end of a band/cord, e.g. US20150005141A1; US 20060084556A1; US20170028245A1; U.S. Pat. Nos. 10,695,604B2; 4,852,874A; 7,931,572B1; 11,452,900B2 which are limited by the lack of adjustability due to their single length.

Exercisers commonly use several of these devices and often need to change the resting length of the band/cord to provide a new tension/resistance level for each individual exercise. Currently, this is achieved in various inefficient ways depending on whether the existing exercise device is retractable or non-retractable. For existing non-retractable exercise devices, the user achieves this change in resting length of a band/cord by giving up one or both handles to grasp the band/cord directly. This loss of the handle decreases the stability of the anchor, lessening the effectiveness and comfort of the exercise for the user. For existing retractable devices, this change in resting length of the band/cord is often achieved by attaching one of the ends to another object, e.g. U.S. Pat. No. 7,621,856B2; US20060201450A1. This adjustment results in a loss of control, without the user's second hand, limiting the user's portability and adjustability from that end.

Furthermore, U.S. Pat. Nos. 9,333,385B2, 8,403,818B1 and WO 2003095034A2 have two handles and a retractable locking mechanism on both sides of an elastic band/cord that allows the exercise band/cord to pass through a clip holder to adjust the resting length. However, when shortening the length, the excess elastic band/cord is left hanging, like an untethered end of a waist belt, distracting the user from the exercise. Finally, U.S. Pat. No. 8,105,214B2 has two handles and a cord between them but uses a flywheel mechanism on one side and a spring-loaded sliding block mechanism on the other side making adjustability complex with two systems. In these examples, the process of adjusting the length of the band/cord is inefficient and cumbersome requiring manual pulling/pushing of the untethered end and multiple systems respectively. Thus, there is a need for an improved automatically retractable band/cord device which is bilateral and yet simple to use.

SUMMARY OF THE EMBODIMENTS

Bilateral spool mechanisms, each contained within a housing, share a common band/cord between them. This band/cord can be pulled out from or retractably coiled back into the housings on either or both sides through a housing opening slot. Retraction springs, attached to one end of each of the spool mechanisms, spin the spool to wrap the band/cord to a retracted state around the spool axel within each housing. Band/cord locking mechanisms rest along the outside of each housing opening slot to secure the band/cord at different lengths once pulled out from the housings by their attached handles. Handle connection elements exist on each handle to secure them together when needed.

Advantages

This adjustable, bilateral, retractable band/cord device with handles is advantageous to any prior art by maintaining the handle function for anchoring and comfort on both ends even when the length of the band/cord changes to provide for a variety of uses. The simple adjustability and locking of length of the band/cord, with its unused portion neatly wound within the housing member, achieves efficiency and portability as well. Different materials, sizes, and/or shapes, etc. for each of the elements allow for different uses of the device. These and other features of these embodiments will become readily apparent upon further review of the following specification and drawings.

DRAWINGS—BRIEF DESCRIPTION

FIG. 1 is a front perspective view of the embodiment's external elements including the band element 134 aligned with and between the housing members 116 but not attached to internal spool/spindle elements 236 (not shown).

DRAWINGS—DETAILED DESCRIPTION—BILATERAL RETRACTABLE ELASTIC BAND EXERCISE DEVICE WITH HANDLES

Figure 1:
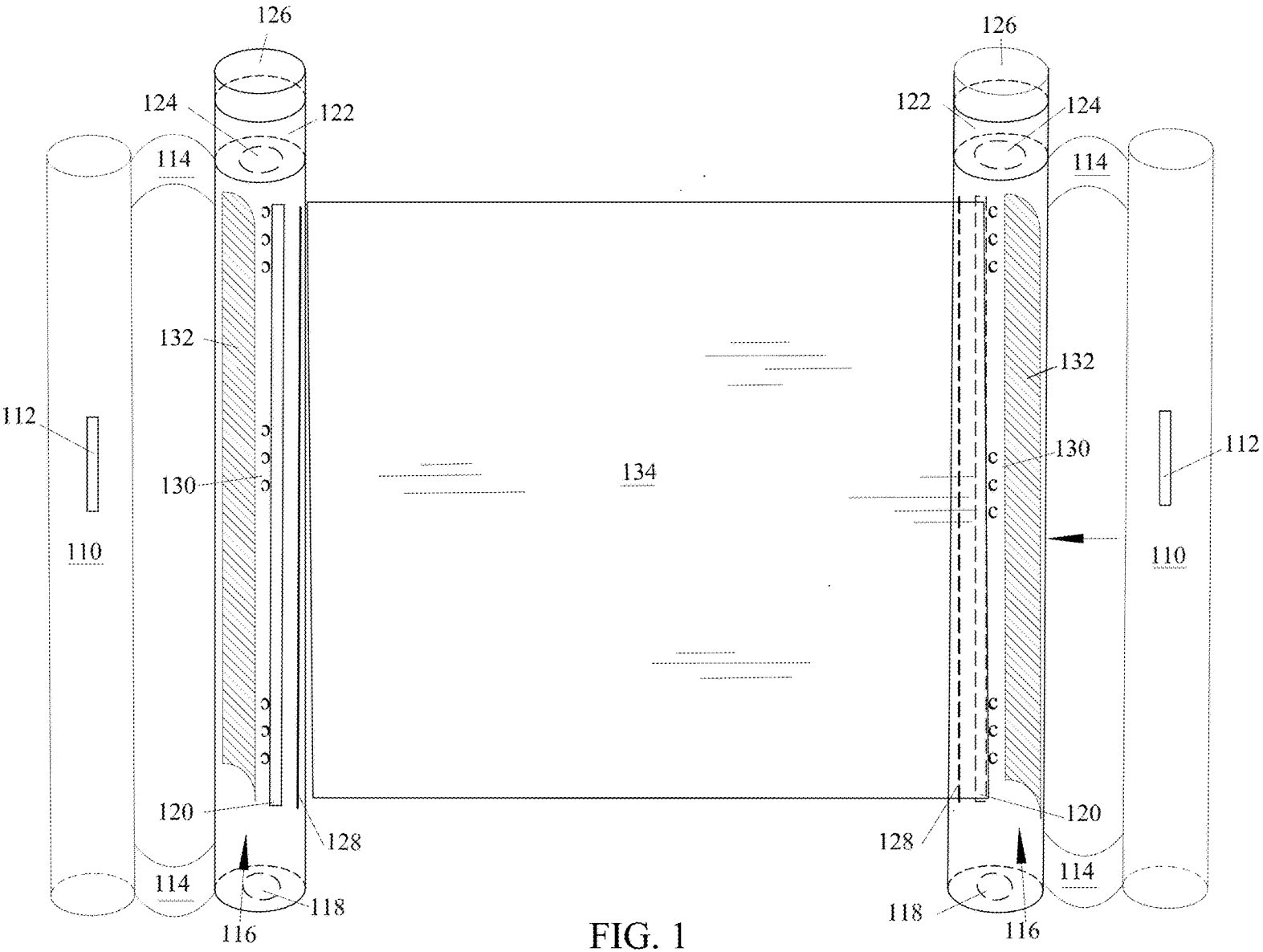

FIG. 1 is a front perspective view of the elements of a hand-held, bilateral, retractable elastic band exercise device. Duplicate elements exist on each side of a shared elastic band element 134. The outside ends of the bilateral retractable band device each consist of a hand-size, cylindrical handle element 110. Handle connection elements 112 are on the front and back (not shown) sides of these handle elements 110. Adjacently connected to each end of the handle elements 110 is a short handle attachment element 114 extending inward. In between these handle attachment elements 114 and the elastic band element 134 is another hand-size, cylindrical, hollow housing member 116 which is open at the top end and closed at the bottom end. Through the center of the closed bottom end is a small, round housing member hole 118. Additionally, each of these housing members 116 have housing opening slots 120 along their full longitudinal length directly facing the elastic band element 134. Short, hollow, cylindrical retraction spring cavities 122 are contiguous with and close the top of each housing member 116. Each retraction spring cavity 122 has an open top end along with a closed bottom end with a small, round retraction spring cavity hole 124. A thin matching retraction spring cavity top 126 closes the retraction spring cavity 122 from above. The inwardly extending handle attachment elements 114, from the handle element 110, attach on top and bottom to the corresponding ends of the housing member 116. Slightly raised locking mechanism fasteners 128 are located on the housing members 116 adjacent and parallel to the length of the housing opening slots 120. Along the opposite sides of these housing opening slots 120 there exists a locking mechanism connectors element 130, in a "C" configuration, facing away from the housing opening slots 120. Long, rectangular locking mechanisms 132, the length of the housing opening slots 120, align with the locking mechanism connectors element 130. One elastic band element 134 lies between housing members 116.

Figure 2:
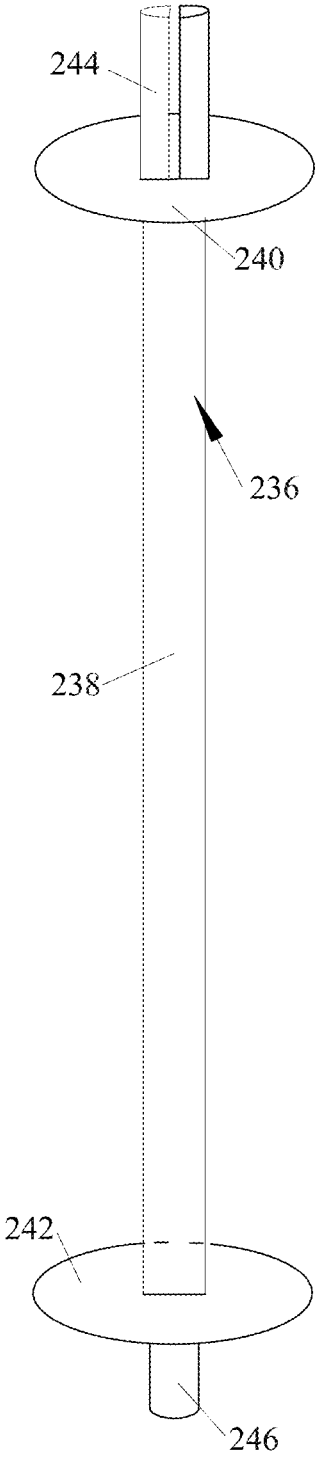
FIG. 2 Prior Art
FIG. 2 is a front perspective view of one of the internal housing spool/spindle elements 236.

FIG. 2 is a front perspective view of a thin, hand-size, spool/spindle element 236. A long spool axel 238 lies between a top spool/spindle element flange 240 and a bottom spool/spindle element flange 242. Above the top spool/spindle element flange 240, there is a short, full thickness spool axel slot 244 that remains open through the top. Below the bottom spool/spindle element flange 242, there is a short, solid, cylindrical spool axel extension 246.

Figure 3:
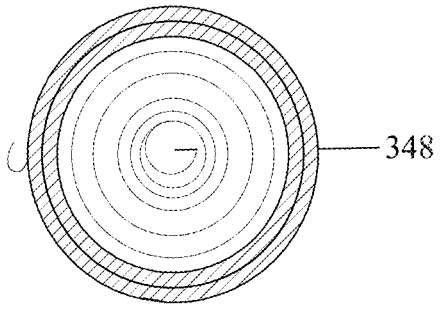
FIG. 3 Prior Art
FIG. 3 is a top orthogonal view of a retraction spring 348.

FIG. 3 is a top orthogonal view of a retraction spring 348.

Figure 4A:
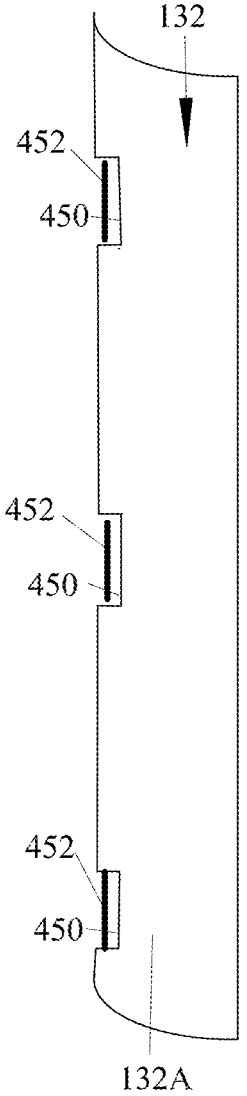
FIG. 4 is a front perspective view of a locking mechanism outer surface 132A (FIG. 4A) and locking mechanism under surface 132B (FIG. 4B).
Figure 4B:
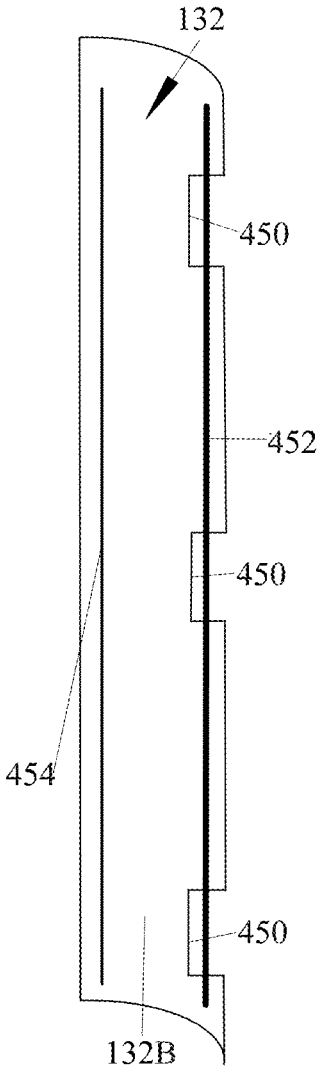

FIG. 4 (4A-4B) is a front perspective view of one of the locking mechanisms 132; its outer surface 132A and its under surface 132B. There are three small open square locking mechanism connectors element cut outs 450 on the left border of the locking mechanism outer surface 132A and the right border of the locking mechanism under surface 132B; one central, one near the top edge, and one near the bottom edge. A full longitudinal length cylindrical locking mechanism tube 452 is connected to the locking mechanism under surface 132B along the same border as the locking mechanism connectors element cut outs 450. This locking mechanism tube 452 crosses each locking mechanism connectors element cut out 450 in the locking mechanism outer surface 132A. Along the opposite border of the locking mechanism under surface 132B is a slightly raised locking mechanism clasp 454 that extends its full longitudinal length.

Figure 5:
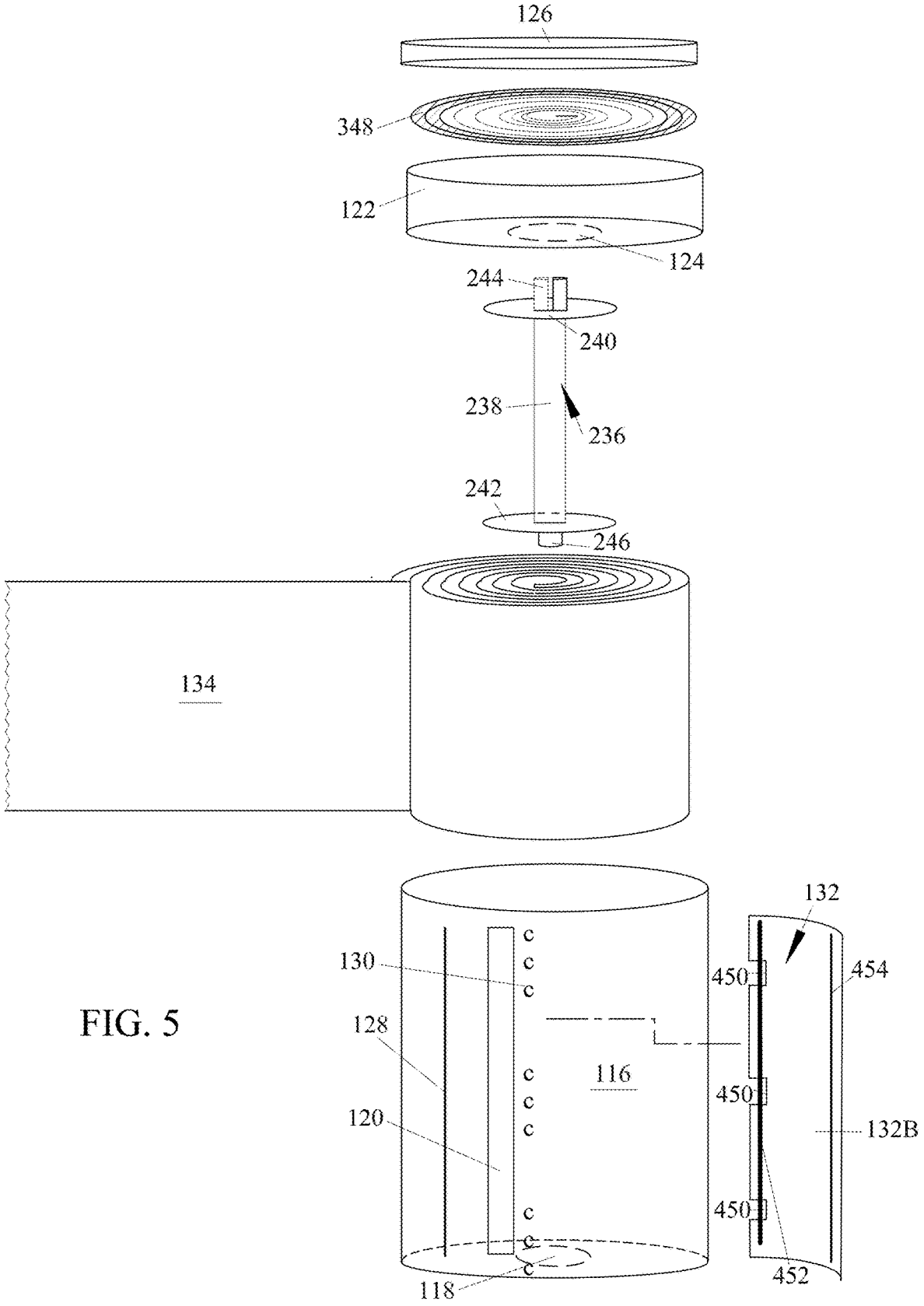
FIG. 5 is a front exploded view of the internal & external components of one of the housing members 116 and its contiguous retraction spring cavity 122.

FIG. 5 is an exploded view of one of the cylindrical housing members 116 with its internal and external components. Through the center of its closed bottom is a small, round housing member hole 118. The housing member 116 has a housing opening slot 120 along its full longitudinal length. A slightly raised locking mechanism fastener 128 is located on the housing member 116 just left, adjacent, and parallel to the length of its housing opening slot 120. Locking mechanism connectors element 130, using a "C" configuration, are located just right, adjacent, and parallel to the length of the housing opening slot 120 with the hook openings facing away from the housing opening slot 120. A long, rectangular locking mechanism 132, the length of the housing opening slot 120, is shown outside to the right of the housing member 116. The locking mechanism connectors element cut outs 450 are on the locking mechanism under surface's 132B left border along with the locking mechanism tube 452. Near its right border is its slightly raised locking mechanism clasp 454. A rolled elastic band element 134, with a slight left pull out, is shown above the housing member 116. A spool/spindle element 236 is risen above the center of the elastic band element 134 with its spool axel 238 and its top spool/spindle element flange 240 and its bottom spool/spindle element flange 242. Above the top spool/spindle element flange 240, there is a short, full thickness spool axel slot 244 that remains open through the top. Below the bottom spool/spindle element flange 242, there is a short, solid, cylindrical spool axel extension 246. Over top the spool/spindle element 236 is a short, cylindrical retraction spring cavity 122. In the bottom of the retraction spring cavity 122 is a retraction spring cavity hole 124. There is a retraction spring 348 that is shown risen from its retraction spring cavity 122. The highest component is the retraction spring cavity top 126.

Figure 6:
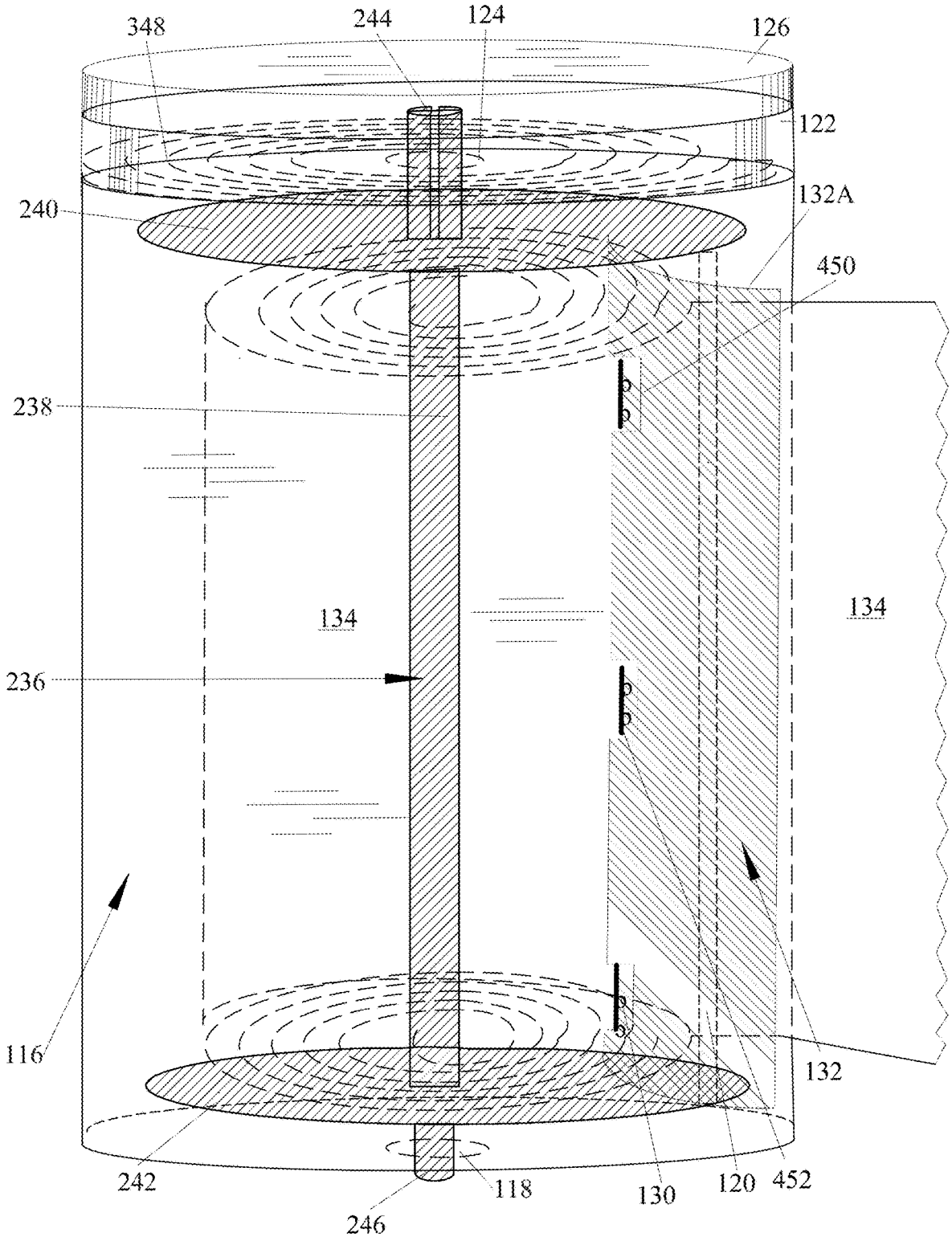
FIG. 6 is a front perspective view of an assembled housing member 116 and its contiguous retraction spring cavity 122 showing its internal and external components.

FIG. 6 is a front perspective view of an assembled housing member 116 and its contiguous retraction spring cavity 122 showing its internal and external components. Covering the retraction spring cavity 122 from above is a retraction spring cavity top 126. A retraction spring 348 is fully contained inside the retraction spring cavity 122. A spool axel slot 244 rises through a bottom-centered retraction spring cavity hole 124 exposing it fully inside the retraction spring cavity 122. The spool axel slot 244 attaches directly to the retraction spring 348 at its center. Immediately below the bottom of the retraction spring cavity 122, inside the top of the housing member 116, and a component of the spool/spindle element 236 is the top spool/spindle element flange 240. The spool axel 238 continues downwardly from the center of the top spool/spindle element flange 240 through the inside core of the rolled elastic band element 134 until it reaches its bottom spool/spindle element flange 242 which is located just above the bottom of the housing member 116. The outside edge of the elastic band element 134 exits from the housing member 116, through the housing opening slot 120, which is covered by the locking mechanism 132, and extends outwardly to the right. The locking mechanism outer surface 132A is connected to the outside of the housing member 116 at the locking mechanism connectors element cut outs 450 via the locking mechanism tube 452 inserting into the locking mechanism connectors element 130. The spool axel extension 246 emerges from the bottom center of the bottom spool/spindle element flange 242 through the housing member hole 118 to the outside of the housing member 116.

Figure 7:
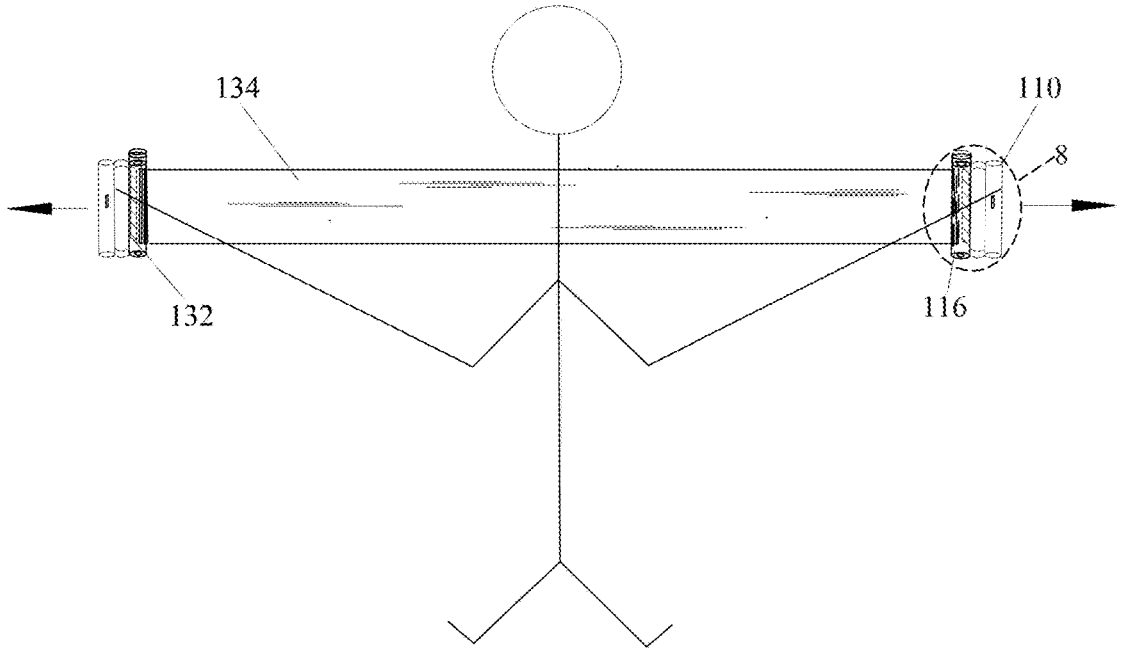
FIG. 7 is a drawing showing an example of an exercise a user may perform using the first embodiment as well as how a user lengthens the band.

FIG. 7 is a drawing showing an example of an exercise a user may perform using this embodiment as well as how one lengthens the elastic band element 134. The bilateral handle elements 110 are being held and pulled in opposite directions by the user's upper extremities. When the bilateral locking mechanisms 132 are engaged, the short ends of the elastic band element 134 are anchored onto each of their respective housing members 116 during the pulling of the handle elements 110 resulting in the user experiencing resistance tension from the elastic band element 134 as a concentric muscular exercise. When one or both of the locking mechanisms 132 are disengaged, the user is pulling the bilateral handle elements 110 and thus their attached bilateral housing members 116 in opposite directions to protract the elastic band element 134 out of one or both housing members 116 to lengthen it to a different resting length.

Figure 9:
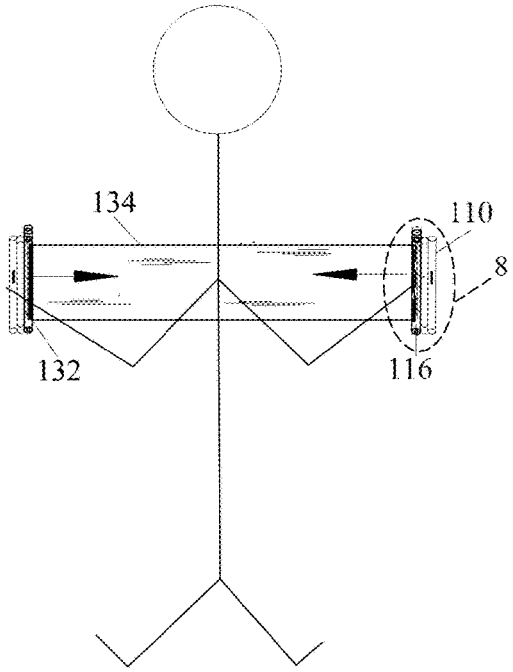
FIG. 9 is a drawing showing an example of an exercise a user may perform using the first embodiment as well as how a user shortens the band.
Figure 8:
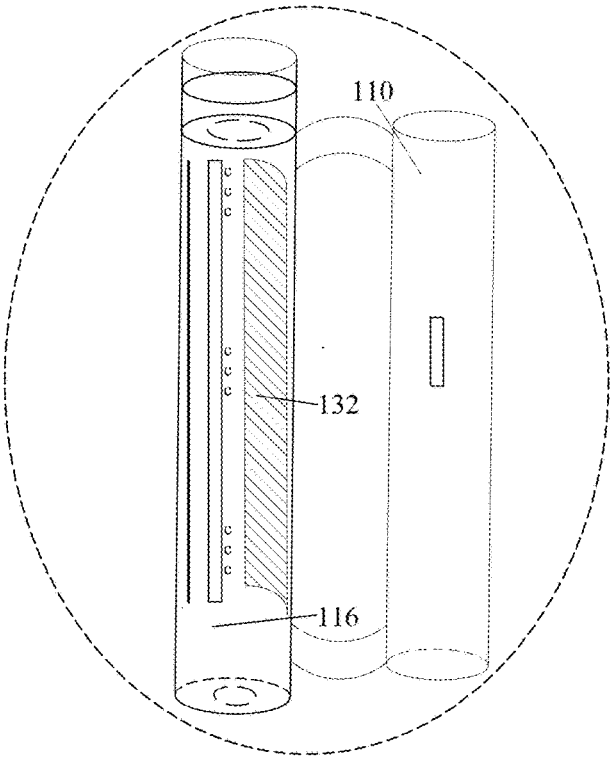
FIG. 8 is an enlarged view of the embodiment held by the user of FIG. 7 and FIG. 9.

FIG. 8 is an enlarged view of the embodiment held by the user of FIG. 7 and FIG. 9.

FIG. 9 is a drawing showing an example of an exercise a user may perform using this embodiment as well as how a user shortens the elastic band element 134. The bilateral hand elements 110 are being held and allowed to move towards each other by the user's upper extremities. When the bilateral locking mechanisms 132 are engaged, the short ends of the elastic band element 134 are anchored onto each of their respective housing members 116 during the moving inwards of the handle elements 110 resulting in the user experiencing a resistance tension from the elastic band element 134 as an eccentric muscular exercise. When one or both of the locking mechanisms 132 are disengaged, the user is allowing the bilateral hand elements 110 and thus their attached bilateral housing members 116 to move towards each other to retract the elastic band element 134 into one or both housing members 116 to shorten it to a different resting length.

Operation—Retractable Elastic Band Exercise Device with Handles

In operation, the user grasps both handle elements 110 simultaneously as bilateral anchors for a plethora of exercises involving the stretching, i.e. pulling, and therefore resistance of the elastic band element 134 that is shared between them. When it is necessary to change the resting length of the elastic band element 134 for a specific exercise, the user disengages the locking mechanism undersurface 132B, i.e. separates the locking mechanism clasp 454 from the locking mechanism fastener 128, on one or both housing members 116. Since the locking mechanism tube 452 is pivotably attached to the locking mechanism connectors element 130 on its opposite long border, disengagement tilts the locking mechanism 132 away from the housing opening slot 120 to uncover it. This action releases the pinching of the elastic band element 134 allowing it to move freely through the housing opening slot 120. The user may now pull one or both handle elements 110, and thus their attached housing members 116, away from the other to lengthen the elastic band element 134 through the housing opening slots 120. This lengthening is achieved by an unwrapping of the elastic band element 134 from around the spool axel 238 via spinning the spool/spindle element 236 within the housing member 116. The elastic band element 134 is secured to the spool/spindle element 236 directly onto the spool axel 238 preventing it from completely detaching if fully unwrapped. Retraction tension is encountered during this elastic band element 134 lengthening process as the spool axel slot 244, which protrudes through the retraction spring cavity hole 124 into the retraction spring cavity 122, is attached to the center of the retraction spring 348 which moves to a coiled state. Optionally, once the locking mechanism 132 is disengaged, the user may choose to move one or both handle elements 110 closer to the other to shorten the elastic band element 134 by allowing the retraction spring 348 to uncoil thus spinning the spool/spindle element 236 in the opposite direction to tightly wrap the elastic band element 134 around the spool axel 238. The user then re-engages the locking mechanism 132, i.e. downwardly presses, the locking mechanism outer surface 132A to attach the locking mechanism clasp 454 to the locking mechanism fastener 128, thus pinching the elastic band element 134 to preserve its new length. During all exercises, the user maintains the use of both handle elements 110 as firm anchors regardless of any change in the length of the elastic band element 134. This makes each individual exercise effectively anchored and comfortable with the desired level of resistance for each user and achieves compact portability, stability, and control of the bilateral retractable band/cord device all in a self-contained environment. Additionally, the user may choose to connect one of the handle elements to their foot or even, outside their body, to a stable structure or object. Finally, one can use this versatile device with another user for a variety of exercises between and for both of them, each benefiting from the advantages of holding one side of the device.

Drawings-Detailed Description-Additional Embodiment-Retractable Band Carry Assist Device with Handles FIG. 1 is a front perspective view of the elements of a hand-held, bilateral, retractable band carry assist device with handles in accordance with the same embodiment. Two distinct elements; housing connection elements 112 and a non-elastic band element 134, are of particular emphasis with this embodiment. Duplicate elements exist on each side of a shared non-elastic band element 134. The outside ends of the bilateral retractable band device each consist of a hand-size, cylindrical handle element 110. Handle connection elements 112 are on the front and back (not shown) sides of these handle elements 110. Adjacently connected to each end of the handle elements 110 is a short handle attachment element 114 extending inward. In between these handle attachment elements 114 and the non-elastic band element 134 is another hand-size, cylindrical, hollow housing member 116 which is open at the top end and closed at the bottom end. Through the center of the closed bottom end is a small, round housing member hole 118. Additionally, each of these housing members 116 have housing opening slots 120 along their full longitudinal length directly facing the non-elastic band element 134. Short, hollow, cylindrical retraction spring cavities 122 are contiguous with and close the top of each housing member 116. Each retraction spring cavity 122 has an open top end along with a closed bottom end with a small, round retraction spring cavity hole 124. A thin matching retraction spring cavity top 126 closes the retraction spring cavity 122 from above. The inwardly extending handle attachment elements 114, from the handle element 110, attach on top and bottom to the corresponding ends of the housing member 116. Slightly raised locking mechanism fasteners 128 are located on the housing members 116 adjacent and parallel to the length of the housing opening slots 120. Along the opposite sides of these housing opening slots 120 there exists a locking mechanism connectors element 130, in a "C" configuration, facing away from the housing opening slots 120. Long, rectangular locking mechanisms 132, the length of the housing opening slots 120, align with the locking mechanism connectors element 130. One non-elastic band element 134 lies between housing members 116.

FIG. 2 is a front perspective view of a thin, hand-size, spool/spindle element 236. A long spool axel 238 lies between a top spool/spindle element flange 240 and a bottom spool/spindle element flange 242. Above the top spool/spindle element flange 240, there is a short, full thickness spool axel slot 244 that remains open through the top. Below the bottom spool/spindle element flange 242, there is a short, solid, cylindrical spool axel extension 246. FIG. 3 is a top orthogonal view of a retraction spring 348.

FIG. 4 (4A-4B) is a front perspective view of one of the locking mechanisms 132; its outer surface 132A and its under surface 132B. There are three small open square locking mechanism connectors element cut outs 450 on the left border of the locking mechanism outer surface 132A and the right border of the locking mechanism under surface 132B; one central, one near the top edge, and one near the bottom edge. A full longitudinal length cylindrical locking mechanism tube 452 is connected to the locking mechanism under surface 132B along the same border as the locking mechanism connectors element cut outs 450. This locking mechanism tube 452 crosses each locking mechanism connectors element cut out 450 in the locking mechanism outer surface 132A. Along the opposite border of the locking mechanism under surface 132B is a slightly raised locking mechanism clasp 454 that extends its full longitudinal length.

FIG. 5 is an exploded view of one of the cylindrical housing members 116 with its internal and external components. Through the center of its closed bottom is a small, round housing member hole 118. The housing member 116 has a housing opening slot 120 along its full longitudinal length. A slightly raised locking mechanism fastener 128 is located on the housing member 116 just left, adjacent, and parallel to the length of its housing opening slot 120. Locking mechanism connectors element 130, using a "C" configuration, are located just right, adjacent, and parallel to the length of the housing opening slot 120 with the hook openings facing away from the housing opening slot 120. A long, rectangular locking mechanism under surface 132B, the length of the housing opening slot 120, is shown outside to the right of the housing member 116. The locking mechanism connectors element cut outs 450 are on the locking mechanism under surface's 132B left border along with the locking mechanism tube 452. Near its right border is its slightly raised locking mechanism clasp 454. A rolled non-elastic band element 134, with a slight left pull out, is shown above the housing member 116. A spool/spindle element 236 is risen above the center of the non-elastic band element 134 with its spool axel 238 and its top spool/spindle element flange 240 and its bottom spool/spindle element flange 242. Above the top spool/spindle element flange 240, there is a short, full thickness spool axel slot 244 that remains open through the top. Below the bottom spool/spindle element flange 242, there is a short, solid, cylindrical spool axel extension 246. Over top the spool/spindle element 236 is a short, cylindrical retraction spring cavity 122. In the bottom of the retraction spring cavity 122 is a retraction spring cavity hole 124. There is a retraction spring 348 that is shown risen from its retraction spring cavity 122. The highest component is the retraction spring cavity top 126.

FIG. 6 is a front perspective view of an assembled housing member 116 and its contiguous retraction spring cavity 122 showing its internal and external components. Covering the retraction spring cavity 122 from above is a retraction spring cavity top 126. A retraction spring 348 is fully contained inside the retraction spring cavity 122. A spool axel slot 244 rises through a bottom-centered retraction spring cavity hole 124 exposing it fully inside the retraction spring cavity 122. The spool axel slot 244 attaches directly to the retraction spring 348 at its center. Immediately below the bottom of the retraction spring cavity 122 inside the top of the housing member 116 and a component of the spool/spindle element 236 is the top spool/spindle element flange 240. The spool axel 238 continues downwardly from the center of the top spool/spindle element flange 240 through the inside core of the rolled non-elastic band element 134 until it reaches its bottom spool/spindle element flange 242 which is located just above the bottom of the housing member 116. The outside edge of the non-elastic band element 134 exits from the housing member 116, through the housing opening 120, which is covered by the locking mechanism 132, and extends outwardly to the right. The locking mechanism outer surface 132A is connected to the outside of the housing member 116 at the locking mechanism connectors element cut outs 450 via the locking mechanism tube 452 inserting into the locking mechanism connectors element 130. The spool axel extension 246 emerges from the bottom center of the bottom spool/spindle element flange 242 through the housing member hole 118 to the outside of the housing member 116.

Figure 10:
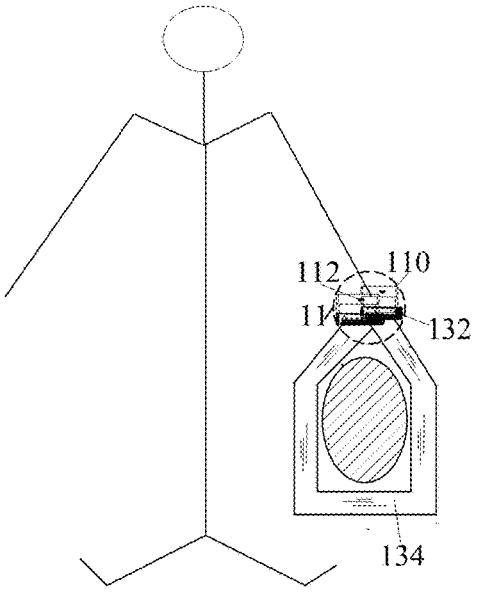
FIG. 10 is a drawing showing an example of how a user may use the second embodiment as a carry assist device.

FIG. 10 is a drawing showing an example of how a user may operate this second embodiment as a carry assist device. The non-elastic band element 134 is wrapped around an oval object being carried by the user in one hand. Bilateral handle elements 110 are secured together with the handle connection elements 112. Both locking mechanisms 132 have been engaged to secure the non-elastic band element 134 tautly around the object. The user is grasping both handle elements 110 with one hand.

Figure 11:
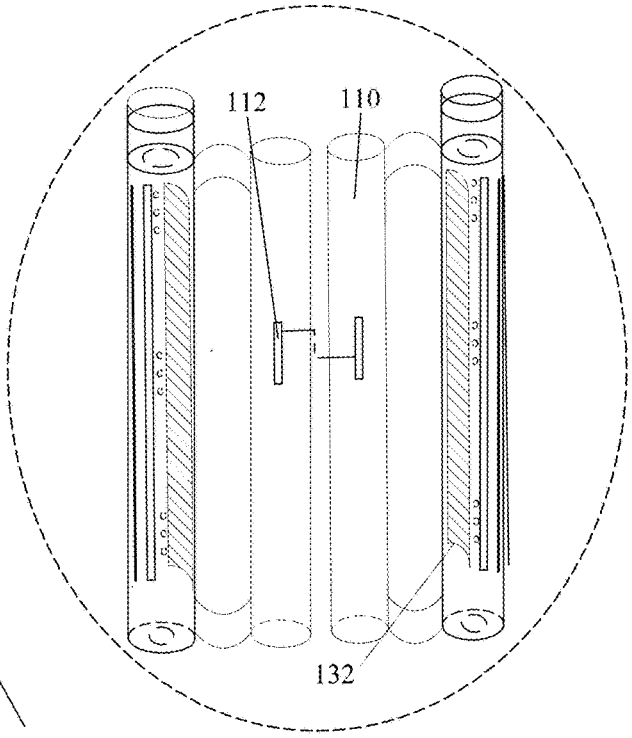
FIG. 11 is an enlarged view of the embodiments used in FIG. 10 (rotated 90 degrees) and FIG. 12.

FIG. 11 is an enlarged view of the embodiments used in FIG. 10 rotated 90 degrees.

Operation—Additional Embodiment—Retractable Band Carry Assist Device with Handles In operation, the user disengages the locking mechanism undersurface 132B, i.e. separates the locking mechanism clasp 454 from the locking mechanism fastener 128, on one or both housing members 116. Since the locking mechanism tube 452 is pivotably attached to the locking mechanism connectors element 130 on its opposite long border, disengagement tilts the locking mechanism 132 away from the housing opening slot 120 to uncover it. This action releases the pinching of the non-elastic band element 134 allowing it to move freely through the housing opening slot 120. The user may now pull one or both handle elements 110, and thus their attached housing members 116, away from the other to lengthen the non-elastic band element 134 through the housing opening slots 120 and wrap it tightly around an object to carry. This lengthening is achieved by an unwrapping of the non-elastic band element 134 from around the spool axel 238 via spinning the spool/spindle element 236 within the housing member 116. The non-elastic band element 134 is secured to the spool/spindle element 236 directly onto the spool axel 238 preventing it from completely detaching if fully unwrapped. Retraction tension is encountered during this non-elastic band element 134 lengthening process as the spool axel slot 244, which protrudes through the retraction spring cavity hole 124 into the retraction spring cavity 122, is attached to the center of the retraction spring 348 which moves to a coiled state. The user then re-engages the locking mechanism 132, i.e. downwardly presses, the locking mechanism outer surface 132A to attach the locking mechanism clasp 454 to the locking mechanism fastener 128, on one or both housing members 116, thus pinching the non-elastic band element 134 to preserve its new length tautly around the object. This brings both the handle elements 110 together and secures the object by attaching the handle connection elements 112 to each other. The user can then use both handle elements 110, with one or both hands or even a mechanical instrument, to lift and carry the object. Thus, a portable, efficient, and effective carry assist bilateral retractable band/cord device that adapts to a variety of sized objects.

Drawings—Detailed Description—Additional Embodiment—Retractable Band Belt with Fasteners FIG. 1 is a front perspective view of the elements of a bilateral retractable band belt device in accordance with the same two above embodiments, but with emphasis on a smaller, waist-size device overall. Duplicate elements exist on each side of a shared elastic or non-elastic belt band element 134. The outside ends of the bilateral retractable belt device each consist of a small, belt-width sized, cylindrical belt buckle handle element 110. Belt buckle handle connection elements 112 are on the front and back (not shown) sides of these belt buckle handle elements 110. Adjacently connected to each end of the belt buckle handle elements 110 is a short belt buckle handle attachment element 114 extending inward. In between these belt buckle handle attachment elements 114 and the elastic or non-elastic belt band element 134 is another small, belt width sized, cylindrical, hollow housing member 116 which is open at the top end and closed at the bottom end. Through the center of the closed bottom end is a small, round housing member hole 118. Additionally, each of these housing members 116 have housing opening slots 120 along their full longitudinal length directly facing the elastic or non-elastic belt band element 134. Short, hollow, cylindrical retraction spring cavities 122 are contiguous with and close the top of each housing member 116. Each retraction spring cavity 122 has an open top end along with a closed bottom end with a small, round retraction spring cavity hole 124. A thin matching retraction spring cavity top 126 closes the retraction spring cavity 122 from above. The inwardly extending belt buckle handle attachment elements 114, from the belt buckle handle element 110, attach on top and bottom to the corresponding ends of the housing member 116. Slightly raised locking mechanism fasteners 128 are located on the housing members 116 adjacent and parallel to the length of the housing opening slots 120. Along the opposite sides of these housing opening slots 120 there exists a locking mechanism connectors element 130, in a "C" configuration, facing away from the housing opening slots 120. Rectangular locking mechanisms 132, the length of the housing opening slots 120, align with the locking mechanism connectors element 130. One elastic or non-elastic belt band element 134 lies between housing members 116.

FIG. 2 is a front perspective view of a thin, waist-size, spool/spindle element 236. A long spool axel 238 lies between a top spool/spindle element flange 240 and a bottom spool/spindle element flange 242. Above the top spool/spindle element flange 240, there is a short, full thickness spool axel slot 244 that remains open through the top. Below the bottom spool/spindle element flange 242, there is a short, solid, cylindrical spool axel extension 246.

FIG. 3 is a top orthogonal view of a retraction spring 348.

FIG. 4 (4A-4B) is a front perspective view of one of the locking mechanisms 132; its outer surface 132A and its under surface 132B. There are three small open square locking mechanism connectors element cut outs 450 on the left border of the locking mechanism outer surface 132A and the right border of the locking mechanism under surface 132B; one central, one near the top edge, and one near the bottom edge. A full longitudinal length cylindrical locking mechanism tube 452 is connected to the locking mechanism under surface 132B along the same border as the locking mechanism connectors element cut outs 450. This locking mechanism tube 452 crosses each locking mechanism connectors element cut out 450 in the locking mechanism outer surface 132A. Along the opposite border of the locking mechanism under surface 132B is a slightly raised locking mechanism clasp 454 that extends its full longitudinal length.

FIG. 5 is an exploded view of one of the cylindrical housing members 116 with its internal and external components. Through the center of its closed bottom is a small, round housing member hole 118. The housing member 116 has a housing opening slot 120 along its full longitudinal length. A slightly raised locking mechanism fastener 128 is located on the housing member 116 just left, adjacent, and parallel to the length of its housing opening slot 120. Locking mechanism connectors element 130, using a "C" configuration, are located just right, adjacent, and parallel to the length of the housing opening slot 120 with the hook openings facing away from the housing opening slot 120. A rectangular locking mechanism 132, the length of the housing opening slot 120, is shown outside to the right of the housing member 116. The locking mechanism connectors element cut outs 450 are on the locking mechanism under surface's 132B left border along with the locking mechanism tube 452. Near its right border is its slightly raised locking mechanism clasp 454. A rolled elastic or non-elastic belt band element 134, with a slight left pull out, is shown above the housing member 116. A spool/spindle element 236 is risen above the center of the elastic or non-elastic belt band element 134 with its spool axel 238 and its top spool/spindle element flange 240 and its bottom spool/spindle element flange 242. Above the top spool/spindle element flange 240, there is a short, full thickness spool axel slot 244 that remains open through the top. Below the bottom spool/spindle element flange 242, there is a short, solid, cylindrical spool axel extension 246. Over top the spool/spindle element 236 is a short, cylindrical retraction spring cavity 122. In the bottom of the retraction spring cavity 122 is a retraction spring cavity hole 124. There is a retraction spring 348 that is shown risen from its retraction spring cavity 122. The highest component is the retraction spring cavity top 126.

FIG. 6 is a front perspective view of an assembled housing member 116 and its contiguous retraction spring cavity 122 showing its internal and external components. Covering the retraction spring cavity 122 from above is a retraction spring cavity top 126. A retraction spring 348 is fully contained inside the retraction spring cavity 122. A spool axel slot rises through a bottom-centered retraction spring cavity hole 124 exposing it fully inside the retraction spring cavity 122. The spool axel slot 244 attaches directly to the retraction spring 348 at its center. Immediately below the bottom of the retraction spring cavity 122 inside the top of the housing member 116 and a component of the spool/spindle element 236 is the top spool/spindle element flange 240. The spool axel 238 continues downwardly from the center of the top spool/spindle element flange 240 through the inside core of the rolled elastic or non-elastic belt band element 134 until it reaches its bottom spool/spindle element flange 242 which is located just above the bottom of the housing member 116. The outside edge of the elastic or non-elastic belt band element 134 exits from the housing member 116, through the housing opening 120, which is covered by the locking mechanism 132, and extends outwardly to the right. The locking mechanism outer surface 132A is connected to the outside of the housing member 116 at the locking mechanism connectors element cut outs 450 via the locking mechanism tube 452 inserting into the locking mechanism connectors element 130. The spool axel extension 246 emerges from the bottom center of the bottom spool/spindle element flange 242 through the housing member hole 118 to the outside of the housing member 116.

Figure 12:
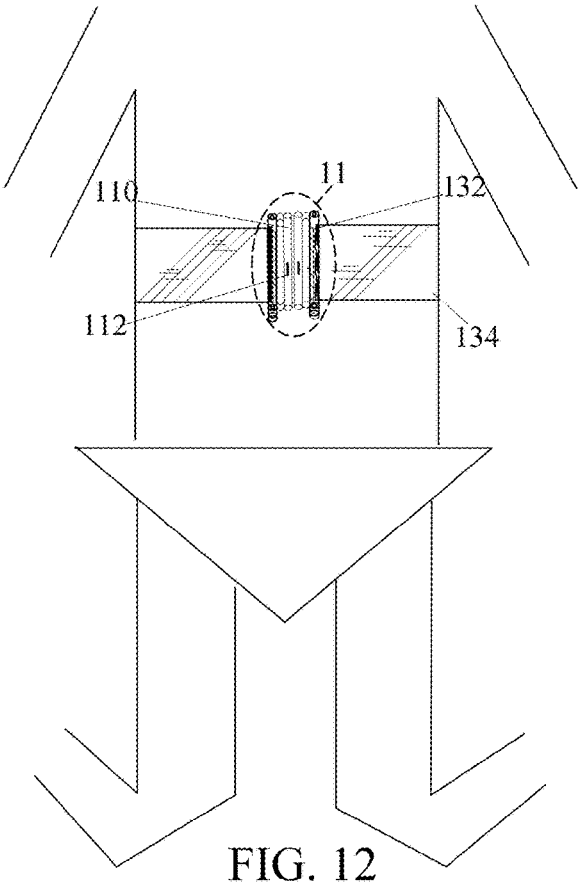
FIG. 12 is a drawing showing an example of how a user may use the third embodiment as a belt.

FIG. 11 is an enlarged view of the embodiments used in FIG. 12.

FIG. 12 is a drawing showing an example of how a user may operate this third embodiment as a belt. The elastic or non-elastic band element 134 is wrapped around the user's waist after both locking mechanisms 132 have been disengaged. Bilateral handle elements 110 are secured together as a belt buckle by the handle connection elements 112. The locking mechanisms 132 have been re-engaged to hold the elastic or non-elastic band element 134 tautly in place.

Operation—Additional Embodiment—Retractable Band Belt with Fasteners

In operation, the user disengages the locking mechanism undersurface 132B, i.e. separates the locking mechanism clasp 454 from the locking mechanism fastener 128, on one or both housing members 116. Since the locking mechanism tube 452 is pivotably attached to the locking mechanism connectors element 130 on its opposite long border, disengagement tilts the locking mechanism 132 away from the housing opening slot 120 to uncover it. This action releases the pinching of the elastic or non-elastic belt band element 134 allowing it to move freely through the housing opening slot 120. The user may now pull one or both belt buckle handle elements 110, and thus their attached housing members 116, away from the other to lengthen the elastic or non-elastic belt band element 134 through the housing opening slots 120 and wrap it around the user's waist for use as a belt. This lengthening is achieved by an unwrapping of the elastic or non-elastic belt band element 134 from around the spool axel 238 via spinning the spool/spindle element 236 within the housing member 116. The elastic or non-elastic belt band element 134 is secured to the spool/spindle element 236 directly onto the spool axel 238 preventing it from completely detaching if fully unwrapped. Retraction tension is encountered during this elastic or non-elastic belt band element 134 lengthening process as the spool axel slot 244, which protrudes through the retraction spring cavity hole 124 into the retraction spring cavity 122, is attached to the center of the retraction spring 348 which moves to a coiled state. The user then re-engages the locking mechanism 132, i.e. downwardly presses, the locking mechanism outer surface 132A to attach the locking mechanism clasp 454 to the locking mechanism fastener 128, on one or both housing members 116, thus pinching the elastic or non-elastic belt band element 134 to preserve its new length. This brings both the belt buckle handle elements 110 together and secures the belt around the user's waist by attaching the belt buckle handle connection elements 112 to each other. Given the flexibility to change the sizes of all the components, a plethora of styles and functions of belts and belt buckles can be achieved.

Drawings—Reference Numerals

110 handle element
112 handle connection element
114 handle attachment element
116 housing member
118 housing member hole
120 housing opening slot
122 retraction spring cavity
124 retraction spring cavity hole
126 retraction spring cavity top
128 locking mechanism fastener
130 locking mechanism connectors element
132 locking mechanism
132A locking mechanism outer surface
132B locking mechanism under surface
134 band element
236 spool/spindle element
238 spool axel
240 top spool/spindle element flange
242 bottom spool/spindle element flange
244 spool axel slot
246 spool axel extension
348 retraction spring
450 locking mechanism connectors element cut out
452 locking mechanism tube
454 locking mechanism clasp

CONCLUSION, RAMIFICATIONS, AND SCOPE

The embodiments show that this more compact bilateral retractable band/cord device with handles on both sides (FIG. 1) can be used for a multitude of functions and activities. The additional stability, comfort, and interconnecting bilateral handle elements 110 are an improvement from other similar devices. Even the bilateral locking mechanisms 132, that fix the band element 134 at any desired length, distinctively contribute to this versatile device that is simple to operate, efficient, compact, portable, and easily adapts to a variety of lengths, sizes, and materials for a collection of uses.

For example, when the band element 134 is elastic, use as a multi-tonic exercise device allows for the handle elements 110 to remain constantly useful with all exercises. The bilateral retractable housing members 116, with their locking mechanisms 132, provide stable fixes of the band element 134 at any length; and thus various resistance levels, for a multitude of self-contained exercises. Generally making the handle elements 110 and/or handle attachment elements 114 from different flexible and/or non-flexible materials will allow for diversities of comfort and stability as well as versatility when using the handle elements 110 with your hands, feet, or even looped around another object. Another example, when the band element 134 is non-elastic, is use as a carry assist device. Such a device is portable and effective by wrapping the non-elastic band element 134 around an object to be carried and tightening it snugly with the retractable housing members 116 and locking mechanisms 132. Connecting the handle elements 110 together, with the effective handle connection elements 112, to grasp comfortably with the user's hand, allows for a successful carrying of the object by an individual. Again, use of various materials for the handle elements 110, handle attachment elements 114, and handle connection elements 112 also allows for carrying to occur by machine or even two users; each holding one of the handle elements 110 on each side of the object. A personal attire example for use of this retractable band device is as a belt with either an elastic or non-elastic band element 134. The device is adjustable to a user's waist size via the retractable housing members 116 and locking mechanisms 132. Creative forms of the handle elements 110 can be made using a variety of materials, sizes, and shapes to attach them to each other as a belt buckle using the handle connection elements 112.

These descriptive examples are important illustrations of a few of the many embodiments of this device. Its scope is broad and can be further highlighted with the addition of the following examples. The device can be used to bundle and store a quantity of individual longitudinal items by wrapping and securing them. When one individual item from the bundle needs to be added or taken away from the bundle, the device has the flexibility to disconnect, unlock, expand or retract respectively, lock, and reconnect quickly and easily. It can also be used in sports training by wrapping the elastic band/cord around an athlete's waist to resist their running progress during speed training with more adjustability, hand control, and functionality than current devices. Another example of use for this device is as a strap to secure luggage to the top of a car during travel. Having the handles connect to each other on the inside ceiling of the vehicle allows for "in-transit" adjustments in tightness if necessary. One last example of the device's many uses is as an elastic compression device with magnetic connectors and weak or missing locking components so it can self-adjust as the object being contained expands or retracts underneath it. Such a device may be useful to measure degrees of swelling of a bodily extremity via marks of measurement labeled on the band.

In conclusion, the broad scope of this bilateral retractable band/cord device with handles is merely illustrated by the numerous examples of these various embodiments. All the handle components can be made of nylon, hard plastic, or fine steel, etc. for the various embodiments. The band/cord component may consist of elastic or non-elastic materials of variable lengths, widths, and diameters, as long as the housing opening is adjusted to allow for it to pass through. Even the housing, locking component, and spool mechanism may be hard plastic or steel, etc. and waist-belt size up to large construction work size depending upon the use of the device. Thus, the ramifications of this device are extensive, but should be determined by the claims that follow.

The invention claimed is:

1. A bilateral retractable band/cord device, each side comprising:

a. a hollow housing member, open at a top thereof and closed at a bottom there of, with a housing opening slot along its length;

b. a retraction spring cavity, open at a top thereof and closed at a bottom there of, contiguous with and covers the open top of said housing member, and having a retraction spring cavity hole in a bottom thereof;

c. a spool/spindle element, disposed fully within said housing member and disposed partially within said retraction spring cavity through said retraction spring cavity hole;

d. a retraction spring, disposed within said retraction spring cavity with a center tab attached to the partially disposed said spool/spindle element;

e. a retraction spring cavity top, closing the open end of said retraction spring cavity;

f. a shared non-elastic band/cord element, with one of a pair of opposite short ends passing through said housing opening slot and connected to said spool/spindle element;

g. a rectangular locking mechanism pivotably affixed to an exterior of said housing configured to be pressed against the shared band/cord element by a user;

h. a spool axel said retraction spring to spin said spool/spindle element from inside said retraction spring cavity leading said shared band/cord element to either be allowed to retract around said spool/spindle element within said housing member or to protract from said spool/spindle element away from said housing member through said housing opening slot, whereby said shared band/cord element is bilaterally retractable/protractible for adjustability and portability.

2. The bilateral retractable band/cord device of claim 1, wherein said band/cord element is made of a non-stretchable material.

3. The bilateral retractable band/cord device of claim 1, further comprising a handle element, with handle connection elements on a front and a back of the handle element, connected to said housing member opposite said housing opening slot.

4. The bilateral retractable band/cord device of claim 3, further comprising handle attachment elements connecting each end of said handle element with the top and the bottom of said housing member, respectfully.

5. The bilateral retractable band/cord device of claim 1, further comprising a locking mechanism fastener along the exterior length of said housing member, adjacent to one side of said housing opening slot.

6. The bilateral retractable band/cord device of claim 5, further comprising a locking mechanism connectors element along the exterior length of said housing member, adjacent to the side of said housing opening slot opposite of said locking mechanism fastener.

7. The bilateral retractable band/cord device of claim 6, wherein one end of said locking mechanism is connected to, and pivotally mobile within, said locking mechanism connectors element.

8. The bilateral retractable band/cord device of claim 7, further comprising a locking mechanism clasp, extending longitudinally along an underside of an unconnected outside end of said locking mechanism aligning to match with said locking mechanism fastener.

9. The bilateral retractable band/cord device of claim 8, wherein said locking mechanism contains a means for selectively inhibiting retraction and protraction of said band/cord element through said housing opening slot via engagement with said band/cord element when said locking mechanism fastener of claim 5 and said locking mechanism clasp are attached to each other, whereby bilaterally locking said band/cord element at a variety of lengths for a multitude of secure uses.

10. The bilateral retractable band/cord device of claim 1, further comprising a housing member hole in the closed bottom of said housing member, within which said spool/spindle element is partially disposed.

11. A bilateral retractable band/cord exercise device, each side comprising:

a. a hollow housing member, open at a top thereof and closed at a bottom there of, with a housing opening slot along a length of the housing member;

b. a retraction spring cavity, open at a top thereof and closed at a bottom there of, contiguous with and covers the open top of said housing member, and having a retraction spring cavity hole in a bottom thereof;

c. a spool/spindle element, disposed fully within said housing member and disposed partially within said retraction spring cavity through said retraction spring cavity hole;

d. a retraction spring, disposed within said retraction spring cavity with a center tab attached to the partially disposed said spool/spindle element;

e. a retraction spring cavity top, closing the open end of said retraction spring cavity;

f. a shared stretchable elastic band/cord element, with one of a pair of opposite short ends passing through said housing opening slot and connected to said spool/spindle element;

g. a rectangular locking mechanism pivotably affixed to an exterior of said housing configured to be pressed against the shared band/cord element by a user;

h. a spool axel said retraction spring to spin said spool/spindle element from inside said retraction spring cavity leading said shared band/cord element to either be allowed to retract around said spool/spindle element within said housing member or to protract from said spool/spindle element away from said housing member through said housing opening slot, whereby said band/cord element is bilaterally retractable/protractible for adjustability accommodating exercise variety and portability.

12. The bilateral retractable band/cord exercise device of claim 11, wherein said band/cord element is made of an elastic material.

13. The bilateral retractable band/cord exercise device of claim 11, further comprising a handle element with handle connection elements on a front and a back of the handle element, connected to said housing member opposite said housing opening slot.

14. The bilateral retractable band/cord exercise device of claim 13, further comprising handle attachment elements connecting each end of said handle element with the top and the bottom of said housing member, respectfully.

15. The bilateral retractable band/cord exercise device of claim 11, further comprising a housing member hole in the closed bottom of said housing member, within which said spool/spindle element is partially disposed.

16. The bilateral retractable band/cord exercise device of claim 11, further comprising a locking mechanism fastener along the exterior length of said housing member, adjacent to one side of said housing opening slot.

17. The bilateral retractable band/cord exercise device of claim 16, further comprising a locking mechanism connectors element along the exterior length of said housing member, adjacent to the side of said housing opening slot opposite of said locking mechanism fastener.

18. The bilateral retractable band/cord exercise device of claim 17, wherein one end of said locking mechanism is connected to, and pivotally mobile within, said locking mechanism connectors element.

19. The bilateral retractable band/cord exercise device of claim 18, further comprising a locking mechanism clasp, extending longitudinally along an underside of an unconnected outside end of said locking mechanism aligning to match with said locking mechanism fastener.

20. The bilateral retractable band/cord exercise device of claim 19, wherein said locking mechanism contains a means for selectively inhibiting retraction and protraction of said band/cord element through said housing opening slot via engagement with said band/cord element when said locking mechanism fastener and said locking mechanism clasp are attached to each other, whereby bilaterally locking said elastic band/cord element easily at a variety of lengths, and thus resistance levels, for a plethora of self-contained exercises while maintaining the handle elements.

* * * * *